US007549484B2

(12) United States Patent
Iwakami et al.

(10) Patent No.: US 7,549,484 B2
(45) Date of Patent: Jun. 23, 2009

(54) POWER TOOL

(75) Inventors: Junichi Iwakami, Anjo (JP); Shinya Bito, Anjo (JP)

(73) Assignee: Makita Corporation, Anjo (JP)

( * ) Notice: Subject to any disclaimer, the term of this patent is extended or adjusted under 35 U.S.C. 154(b) by 31 days.

(21) Appl. No.: 11/713,369

(22) Filed: Mar. 5, 2007

(65) Prior Publication Data

US 2007/0209815 A1 Sep. 13, 2007

(30) Foreign Application Priority Data

Mar. 9, 2006 (JP) ..... 2006-064924

(51) Int. Cl.
*B23B 45/16* (2006.01)
*B23B 45/02* (2006.01)

(52) U.S. Cl. ..... 173/48; 173/104; 173/217

(58) Field of Classification Search ..... 173/47, 173/48

See application file for complete search history.

(56) References Cited

U.S. PATENT DOCUMENTS

| | | | | | |
|---|---|---|---|---|---|
| 3,789,933 | A * | 2/1974 | Jarecki | 173/48 |
| 4,418,766 | A * | 12/1983 | Grossmann | 173/13 |
| 4,506,743 | A * | 3/1985 | Grossmann | 173/48 |
| 4,585,077 | A * | 4/1986 | Bergler | 173/48 |
| 4,763,733 | A * | 8/1988 | Neumaier | 173/48 |
| 4,843,196 | A * | 6/1989 | Bissig et al. | 200/336 |
| 4,895,212 | A * | 1/1990 | Wache | 173/48 |
| 5,056,607 | A * | 10/1991 | Sanders | 173/48 |
| 5,111,889 | A * | 5/1992 | Neumaier | 173/48 |
| 5,842,527 | A * | 12/1998 | Arakawa et al. | 173/48 |
| 6,015,017 | A * | 1/2000 | Lauterwald | 173/48 |
| 6,035,945 | A * | 3/2000 | Ichijyou et al. | 173/48 |
| 6,109,364 | A * | 8/2000 | Demuth et al. | 173/48 |
| 6,176,321 | B1 * | 1/2001 | Arakawa et al. | 173/48 |
| 6,192,996 | B1 * | 2/2001 | Sakaguchi et al. | 173/48 |
| 6,520,267 | B2 * | 2/2003 | Funfer et al. | 173/48 |
| 6,971,455 | B2 * | 12/2005 | Shibata et al. | 173/48 |
| 7,121,359 | B2 * | 10/2006 | Frauhammer et al. | 173/48 |
| 7,331,496 | B2 * | 2/2008 | Britz et al. | 227/48 |
| 2002/0014343 | A1 * | 2/2002 | Funfer et al. | 173/48 |
| 2002/0023763 | A1 * | 2/2002 | Thurler et al. | 173/48 |

(Continued)

FOREIGN PATENT DOCUMENTS

| | | |
|---|---|---|
| JP | Y2-02-030168 | 8/1990 |

(Continued)

*Primary Examiner*—Rinaldi I. Rada
*Assistant Examiner*—Lindsay Low
(74) *Attorney, Agent, or Firm*—Oliff & Berridge, PLC

(57) ABSTRACT

A power tool includes a mode switching device that includes a mode switching member turned by manual operation, a linearly moving driven-side member and a mode switching mechanism actuated by linear motion of the driven-side member. The actuating member is disposed on the mode switching member such that the initial position of the actuating member is located in a position displaced in a radial direction from the rotation axis of the mode switching member. When the mode switching member is turned, the actuating member revolves in a circular arc movement in contact with the driven-side member to linearly move the driven-side member. The actuating member is structured to move radially inward of the mode switching member from the initial position toward the rotation axis of the mode switching member with respect to the mode switching member.

5 Claims, 11 Drawing Sheets

U.S. PATENT DOCUMENTS

2002/0046847 A1* 4/2002 Ichijyou et al. ..... 173/48
2002/0125020 A1* 9/2002 Funfer ..... 173/48
2003/0146007 A1* 8/2003 Greitmann ..... 173/48
2003/0226673 A1* 12/2003 Burger et al. ..... 173/48
2004/0194986 A1* 10/2004 Ikuta ..... 173/48
2004/0211574 A1* 10/2004 Droste et al. ..... 173/29
2004/0231866 A1* 11/2004 Droste ..... 173/48
2005/0028995 A1* 2/2005 Saito et al. ..... 173/176
2007/0102174 A1* 5/2007 Duesselberg et al. ..... 173/48

FOREIGN PATENT DOCUMENTS

WO WO 9315863 A1 * 8/1993

* cited by examiner

POWER TOOL

BACKGROUND OF THE INVENTION

1. Field of the Invention

The present invention relates to a power tool having a mode switching device for switching between a plurality of driving modes.

2. Description of the Related Art

Japanese Utility Model Publication No. 2-30168 discloses an electric hammer drill having a speed changing clutch actuating mechanism capable of switching the rotational speed of a spindle between high-speed mode and low-speed mode. This known hammer drill includes a mode switching device that converts rotation of a switching lever turned by user's manual operation into linear motion of a sliding member via an eccentric pin and transmits the linear motion to a clutch mechanism. A torsion spring is disposed between the eccentric pin and the sliding member. The torsion spring is substantially integrally formed with the sliding member. When engagement of a driving-side clutch member and a driven-side clutch member of the clutch mechanism is interrupted during turning operation of the switching lever for mode change, the torsion spring is elastically deformed and builds up the spring force. Thereafter, when the interruption is resolved, the sliding member is caused to linearly move by the accumulated biasing force of the torsion spring, so that the clutch mechanism is engaged.

With the above-mentioned construction in which the torsion spring is disposed astride between the eccentric pin and the sliding member, the arms of the torsion spring increase in length, so that the torsion spring increases in size. Further, the eccentric pin and the sliding member are disposed apart from each other, so that a wider installation space is required. Therefore, the known mode switching device needs further improvement in these points.

SUMMARY OF THE INVENTION

Accordingly, it is an object of the present invention to provide an effective technique for reducing the size of a mode switching device of a power tool.

The above-described problem can be solved by the features of the claimed invention. According to the invention, a representative power tool is provided to have a mode switching device that switches a driving mode of a tool bit among a plurality of different driving modes. The mode switching device may include a mode switching member, a driven-side member, a mode switching mechanism, an actuating member and an elastic element. The mode switching member can be turned by manual operation. The driven-side member can linearly move in a direction crossing a rotation axis of the mode switching member. The mode switching mechanism is actuate by linear motion of the driven side member. The actuating member is disposed on the mode switching member such that the initial position of the actuating member is located in a position displaced in a radial direction from the rotation axis of the mode switching member.

When the mode switching member is turned, the actuating member is caused to revolve in a circular arc movement in contact with the driven-side member so as to cause the driven-side member to linearly move via components of the circular arc movement in the direction of the linear movement of the driven-side member. The actuating member can move radially inward of the mode switching member from the initial position toward the rotation axis of the mode switching member with respect to the mode switching member.

The elastic element is elastically deformed by the actuating member when the actuating member moves radially inward from the initial position. The elastic element builds up a spring force to return the actuating member to the initial position. When the driven-side member is prevented from moving linearly by interruption of the movement of the mode switching mechanism during turning operation of the mode switching member for mode change, the actuating member moves radially inward of the mode switching member, while elastically deforming the elastic element, thereby allowing the mode switching member to be turned. When the interruption of the movement of the mode switching mechanism is resolved and the linear movement of the driven-side member is allowed in the state in which the mode switching member is turned, the actuating member moves back to the initial position by the accumulated spring force of the elastic element, which causes the driven-side member to linearly move.

According to the invention, the feature of "radially inward movement" may include both a circular arc movement and a linear movement. Further, the manner of "moving radially inward" may include a swinging movement on a fixed point of the mode switching member and a movement along a groove formed in the mode switching member. The feature of "elastic element" may typically include a torsion spring, but alternatively, it may include a compression coil spring or a rubber.

According to the invention, even if the driven-side member is prevented from moving linearly by interruption of the movement of the mode switching mechanism during turning operation of the mode switching member for mode change, the mode switching member can be turned to a desired mode position. Thereafter, when the interruption of the movement of the mode switching mechanism is resolved, the driven-side member can be moved to a predetermined position via the actuating member by the accumulated spring force of the elastic element. In this invention, when the movement of the mode switching mechanism is interrupted, the actuating member moves radially inward, which allows the mode switching member to be continuously turned.

With this construction, the elastic element for applying a spring force to the actuating member can be disposed on the mode switching member side. As a result, the elastic element can be reduced in size. For example, when the elastic element comprises a torsion spring, the arms of the torsion spring can be reduced in length, so that the size of the torsion spring can be reduced. Further, with the construction in which the actuating member directly contacts the driven-side member, the mode switching member and the driven-side member can be disposed adjacent to each other, so that the installation space can be reduced.

Preferably, the radially inward movement of the actuating member with respect to the mode switching member may be a swinging movement on a fixed point other than the rotation axis of the mode switching member. Because the actuating member swings, the actuating member can be efficiently moved radially inward within a limited space.

Further, the actuating member may preferably be adapted and arranged to swing on either of two points which are symmetrically positioned with respect to a line connecting the rotation axis of the mode switching member and the center of the actuating member placed in the initial position. When the actuating member swings on one of the two points, the actuating member may be disengaged from the other point while, when the actuating member swings on the other point, the actuating member may be disengaged from the one point. According to such construction, because the actuating member can swing on either of the two points which are symmetrically positioned with respect to a line connecting the rotation axis of the mode switching member and the center of the actuating member placed in the initial position, no limitation is posed to the direction of turning the mode switching member on the rotation axis. Therefore, mode change can be effected whichever direction, clockwise or counterclockwise, the mode switching member is turned on the rotation axis. Thus, the ease of use in switching operation can be increased.

Further, the power tool may preferably include a tool body having a mounting hole in which the mode switching member is mounted. The mode switching member may include a circular portion which is rotatably fitted in the mounting hole. The circular portion may have a recess formed along the direction of the rotation axis. The elastic element and the entire actuating member except for a portion which contacts the driven-side member may be disposed within the recess. According to such construction, because the actuating member and the elastic element are disposed with the recess of the circular portion or the mode switching member, economical and simple placement can be realized. Moreover, because the actuating member and the elastic element do not protrude radially outward of the circular portion, the circular portion of the mode switching member can be more easily inserted into the insertion hole of the tool body from the axial direction during assembling the power tool.

Other objects, features and advantages of the present invention will be readily understood after reading the following detailed description together with the accompanying drawings and the claims.

BRIEF DESCRIPTION OF THE DRAWINGS

FIG. 7 is a perspective view showing the structure for assembling an eccentric pin and a torsion spring to the cylindrical part of the operating member, in which FIG. 7(B) shows the state during assembling.

DETAILED DESCRIPTION OF THE INVENTION

Each of the additional features and method steps disclosed above and below may be utilized separately or in conjunction with other features and method steps to provide and manufacture improved power tools and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
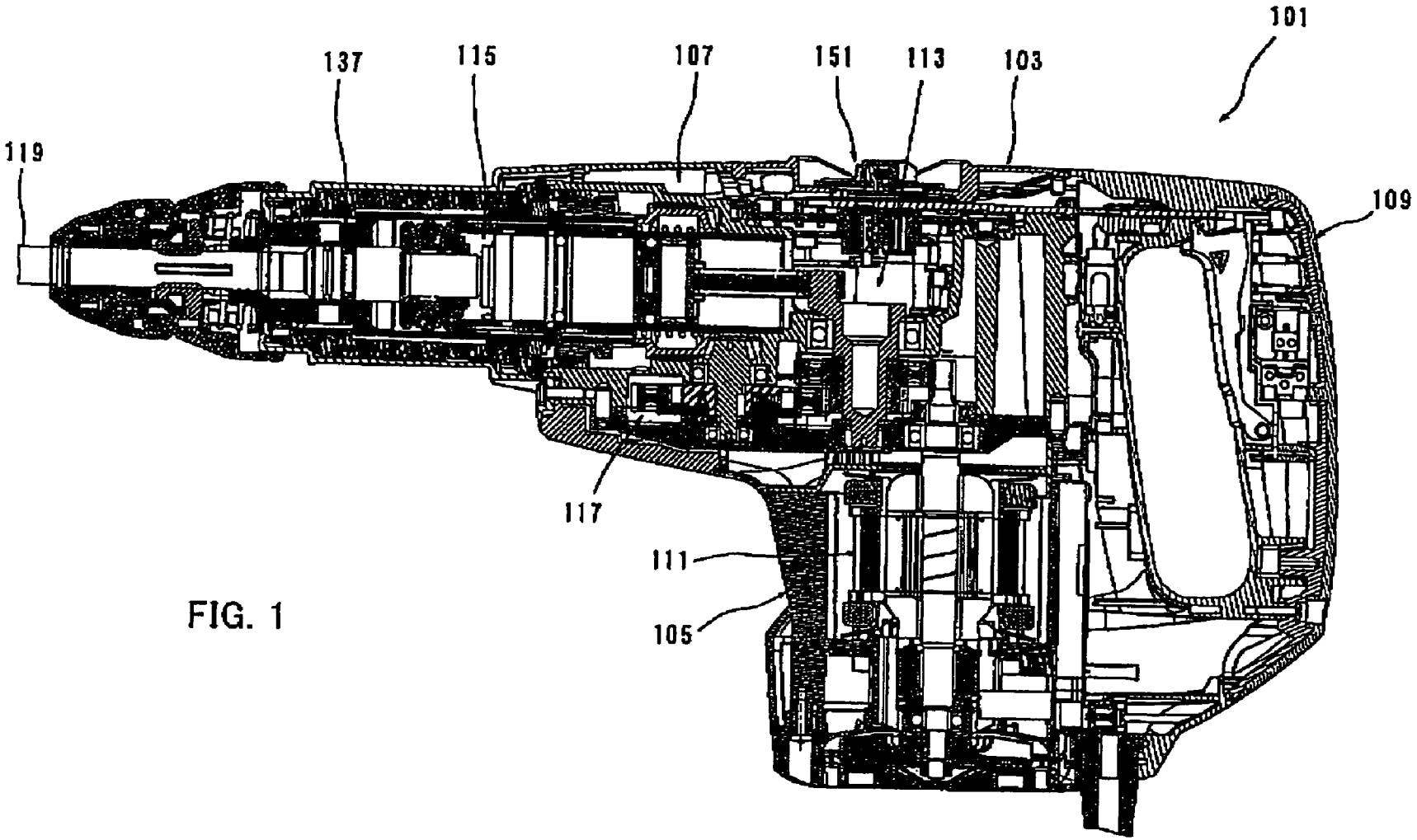
FIG. 1 is a sectional side view schematically showing an entire hammer drill according to an embodiment of the invention.

A representative embodiment of the present invention will now be described with reference to the drawings. FIG. 1 is a sectional side view showing an entire electric hammer drill 101 as a representative embodiment of the power tool having a mode switching device according to the invention. As shown in FIG. 1, the hammer drill 101 of this embodiment includes a body 103, a hammer bit 119 detachably coupled to the tip end region (on the left side as viewed in FIG. 1) of the body 103 via a hollow tool holder 137, and a handgrip 109 that is held by a user and connected to the body 103 on the side opposite to the hammer bit 119. The hammer bit 119 is held by the tool holder 137 such that it is allowed to reciprocate with respect to the tool holder 137 in its axial direction and prevented from rotating with respect to the tool holder in its circumferential direction. The body 103 and the hammer bit 119 are features that correspond to the "tool body" and the "tool bit", respectively, according to the present invention. In the present embodiment, for the sake of convenience of explanation, the side of the hammer bit 119 is taken as the front side and the side of the handgrip 109 as the rear side.

The body 103 includes a motor housing 105 that houses a driving motor 111, and a crank housing 107 that houses a motion converting mechanism 113, a striking mechanism 115 and a power transmitting mechanism 117. The motion converting mechanism 113 is adapted to appropriately convert the rotating output of the driving motor 111 to linear motion and then to transmit it to the striking mechanism 115. As a result, an impact force is generated in the axial direction of the hammer bit 119 via the striking mechanism 115. Further, the speed of the rotating output of the driving motor 111 is appropriately reduced by the power transmitting mechanism 117 and then transmitted to the hammer bit 119. As a result, the hammer bit 119 is caused to rotate in the circumferential direction. The driving motor 111 is driven when a trigger (not shown) on the handgrip 109 is depressed.

Figure 2:
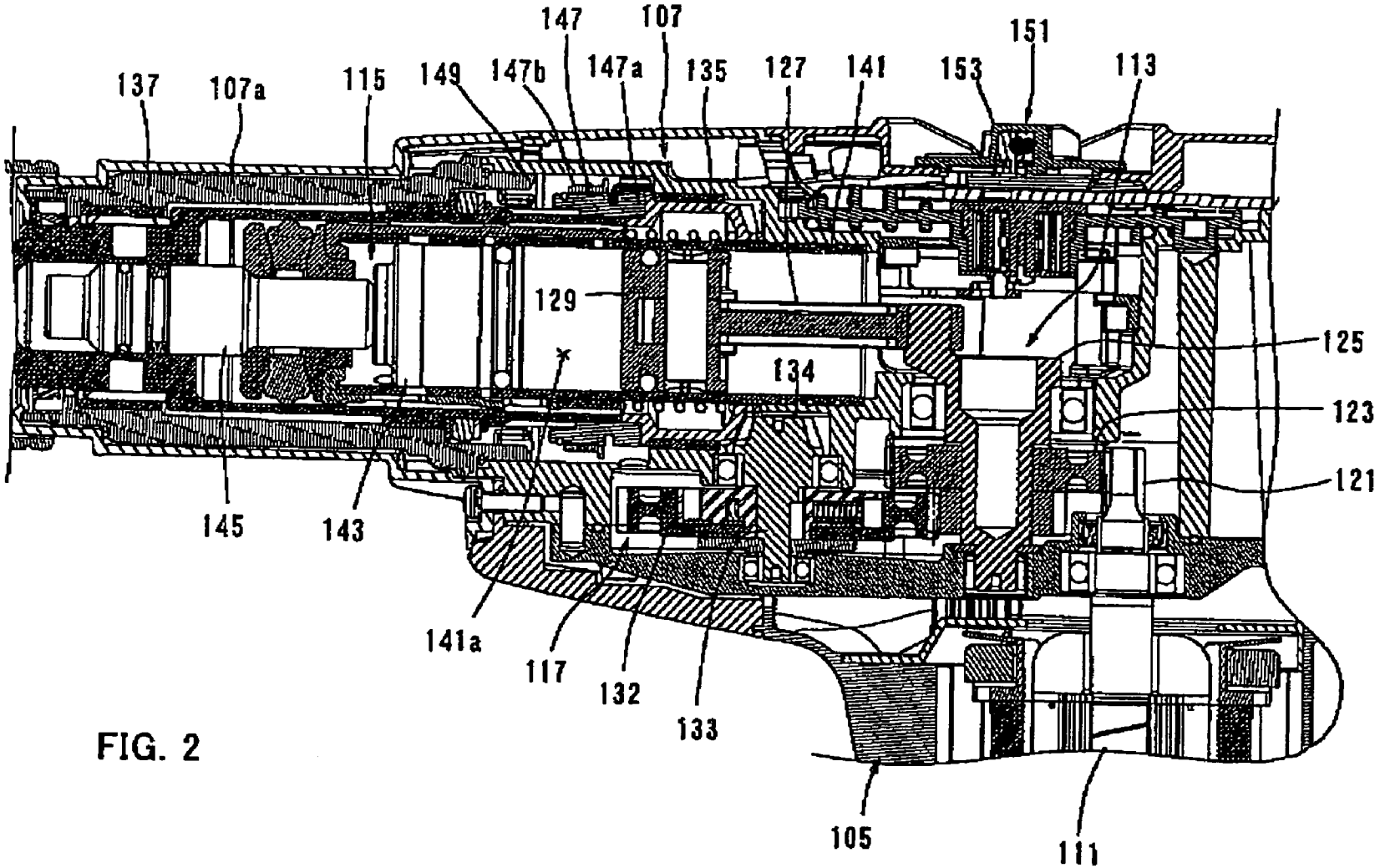
FIG. 2 is a sectional view of an essential part of the hammer drill in the state in which a power transmitting mechanism is in a power transmission state.
Figure 3:
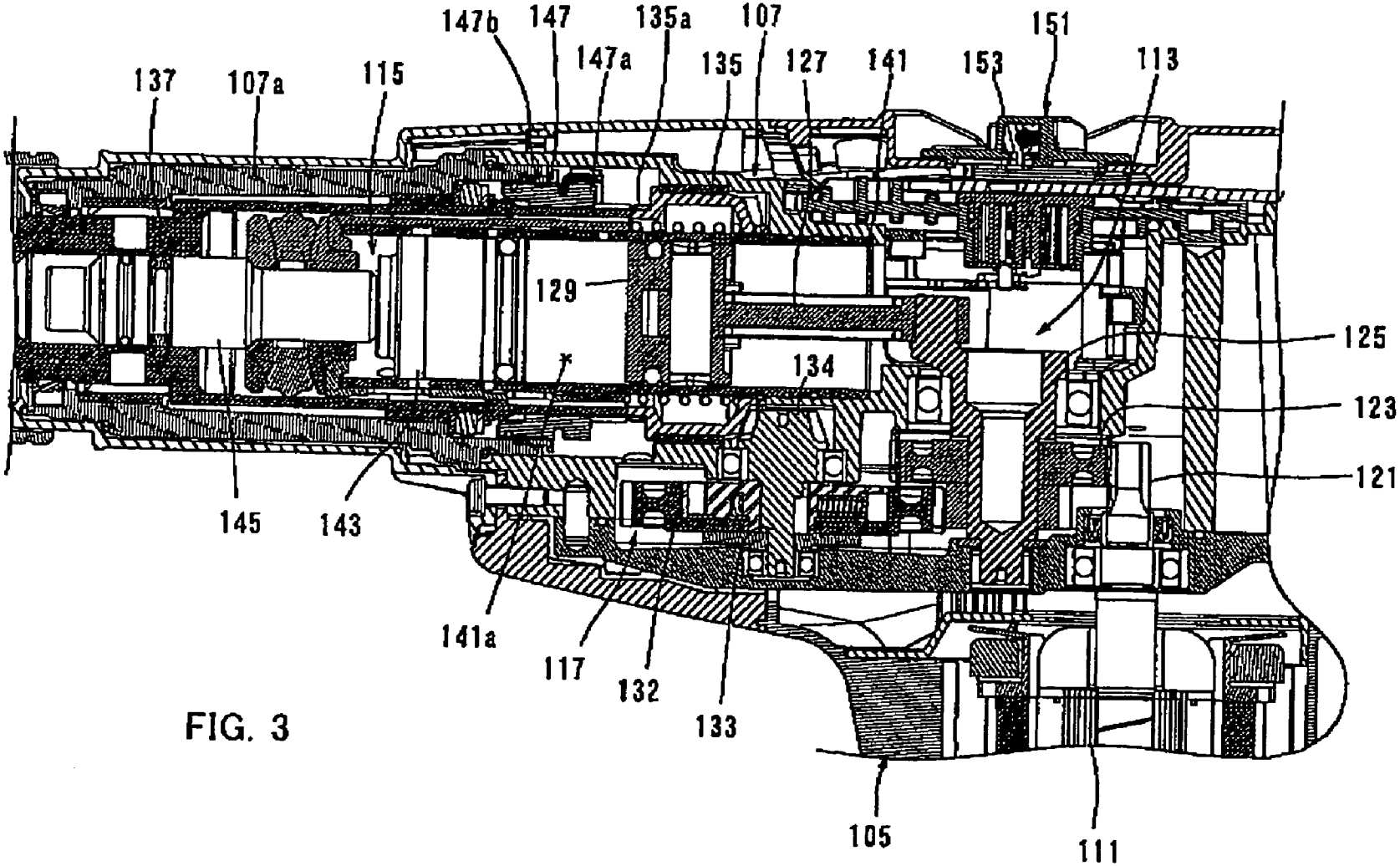
FIG. 3 is a sectional view of the essential part of the hammer drill in the state in which the power transmitting mechanism is in a power transmission interrupted state.

FIGS. 2 and 3 show a primary part of the hammer drill 101 in enlarged sectional view. FIG. 2 shows the state in which the power transmitting mechanism 117 is in a power transmission state, while FIG. 3 shows the state in which the power transmitting mechanism 117 is in a power transmission interrupted state. The motion converting mechanism 113 includes a driving gear 121 that is rotated in a horizontal plane by the driving motor 111, a driven gear 123, a crank shaft 125, a crank arm 127 and a driving element in the form of a piston 129. The crank shaft 125, the crank arm 127 and the piston 129 form a crank mechanism. The piston 129 is slidably disposed within the cylinder 141 and reciprocates along the cylinder 141 when the driving motor 111 is driven.

The striking mechanism 115 includes a striker 143 and an impact bolt 145. The striker 143 is slidably disposed within the bore of the cylinder 141. The impact bolt 145 is slidably disposed within the tool holder 137 and serves as an intermediate element to transmit the kinetic energy of the striker 143 to the hammer bit 119. The striker 143 is driven via the action of an air spring of an air chamber 141*a* of the cylinder 141 which is caused by sliding movement of the piston 129. The striker 143 then collides with (strikes) the impact bolt 145 that is slidably disposed within the tool holder 137, and transmits the striking force to the hammer bit 119 via the impact bolt 145.

The power transmitting mechanism 117 includes an intermediate gear 132 that receives the rotating force of the driving gear 121, an intermediate shaft 133 that rotates together with the intermediate gear 132, a small bevel gear 134 that is caused to rotate in a horizontal plane together with the intermediate shaft 133, a large bevel gear 135 that engages with the small bevel gear 134 and rotates in a vertical plane, and a driving sleeve 147 that engages with the large bevel gear 135 and is caused to rotate. The driving sleeve 147 is spline fitted onto the tool holder 137 such that it can move in the longitudinal direction of the tool holder 137 (the axial direction of the hammer bit 119) while being prevented from moving with respect to the tool holder 137 in the circumferential direction. Therefore, the rotation driving force of the slide sleeve 147 is transmitted to the tool holder 137 and then further transmitted to the hammer bit 119 held by the tool holder 137.

The driving sleeve 147 has clutch teeth 147*a* formed on the inner peripheral surface of one longitudinal end portion (rear end portion) of the driving sleeve 147. The clutch teeth 147*a* engage with clutch teeth 135*a* of the large bevel gear 135 when the driving sleeve 147 moves rearward (toward the handgrip 109) with respect to the tool holder 137 (see FIG. 2). Such engagement is released when the driving sleeve 147 moves forward (toward the hammer bit) with respect to the tool holder 137. In other words, the driving sleeve 147 can be switched between a power transmission state (see FIG. 2) in which the rotation driving force of the large bevel gear 135 is transmitted to the tool holder 137 and a power transmission interrupted state (see FIG. 3) in which such transmission of the driving force is interrupted.

Further, rotation locking clutch teeth 147*b* are formed on the outer peripheral surface of the driving sleeve 147. When the driving sleeve 147 is caused to move forward and switched to the power transmission interrupted state, the clutch teeth 147*b* of the driving sleeve 147 engage with rotation locking fixed teeth 149 formed on the inner peripheral surface of a rear end portion of a barrel part 107*a* of the crank housing 107. As a result, the tool holder 137 and the hammer bit 119 can be locked against fee movement in the circumferential direction (so called "variolock").

When the driving sleeve 147 is caused to move rearward the power transmitting mechanism 117 is switched to the power transmission state. In this state, when a user depresses the trigger to drive the driving motor 111, the rotating output of the driving motor 111 is transmitted to the tool holder 137 via the power transmitting mechanism 117, so that the hammer bit 119 is rotationally driven. At the same time, a striking force is applied to the hammer bit 119 via the crank mechanism and the striking mechanism 115 by driving of the driving motor 111. Specifically, in the state in which the power transmitting mechanism 117 is in the power transmission state, the hammer bit 119 is driven in hammer drill mode in which the hammer bit 119 is caused to perform both the hammering movement in the axial direction and the drilling movement in the circumferential direction.

When the driving sleeve 147 is caused to move forward, the power transmitting mechanism 117 is switched to the power transmission interrupted state. In this state, when the driving motor 111 is driven, a striking force is applied to the hammer bit 119 via the crank mechanism and the striking mechanism 115. Specifically, in the state in which the power transmitting mechanism 117 is in the power transmission interrupted state, the hammer bit 119 is driven in hammer mode in which the hammer bit 119 is caused to perform only the hammering movement in the axial direction. Thus, the driving sleeve 147 forms a clutch mechanism for switching between the hammer mode and the hammer drill mode for driving the hammer bit 119. The driving sleeve 147 is a feature that corresponds to the "mode switching mechanism" according to the invention.

Figure 4:
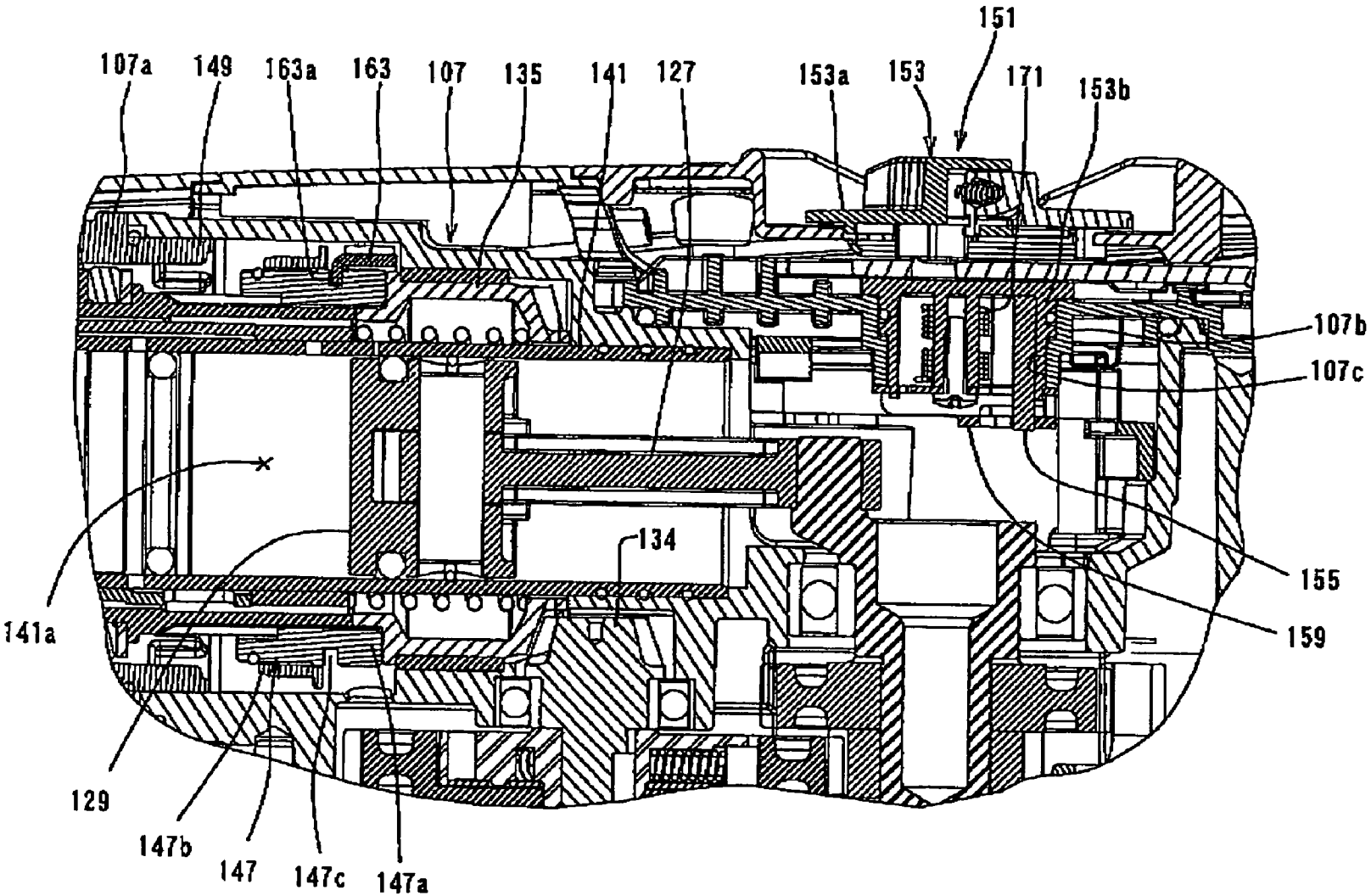
FIG. 4 is an enlarged sectional view showing a mode switching mechanism.
Figure 5:
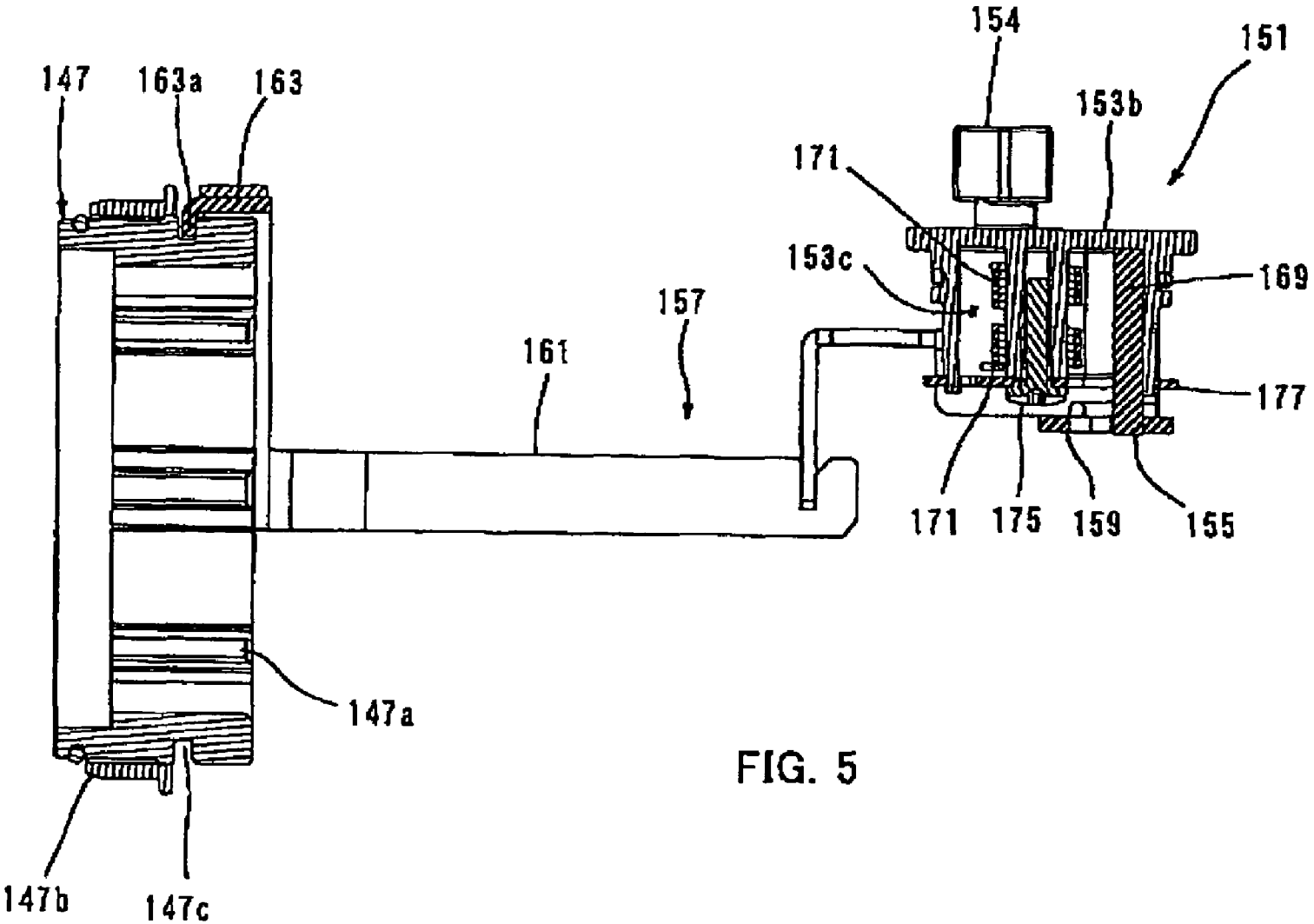
FIG. 5 is a view showing only the mode switching mechanism.
Figure 6:
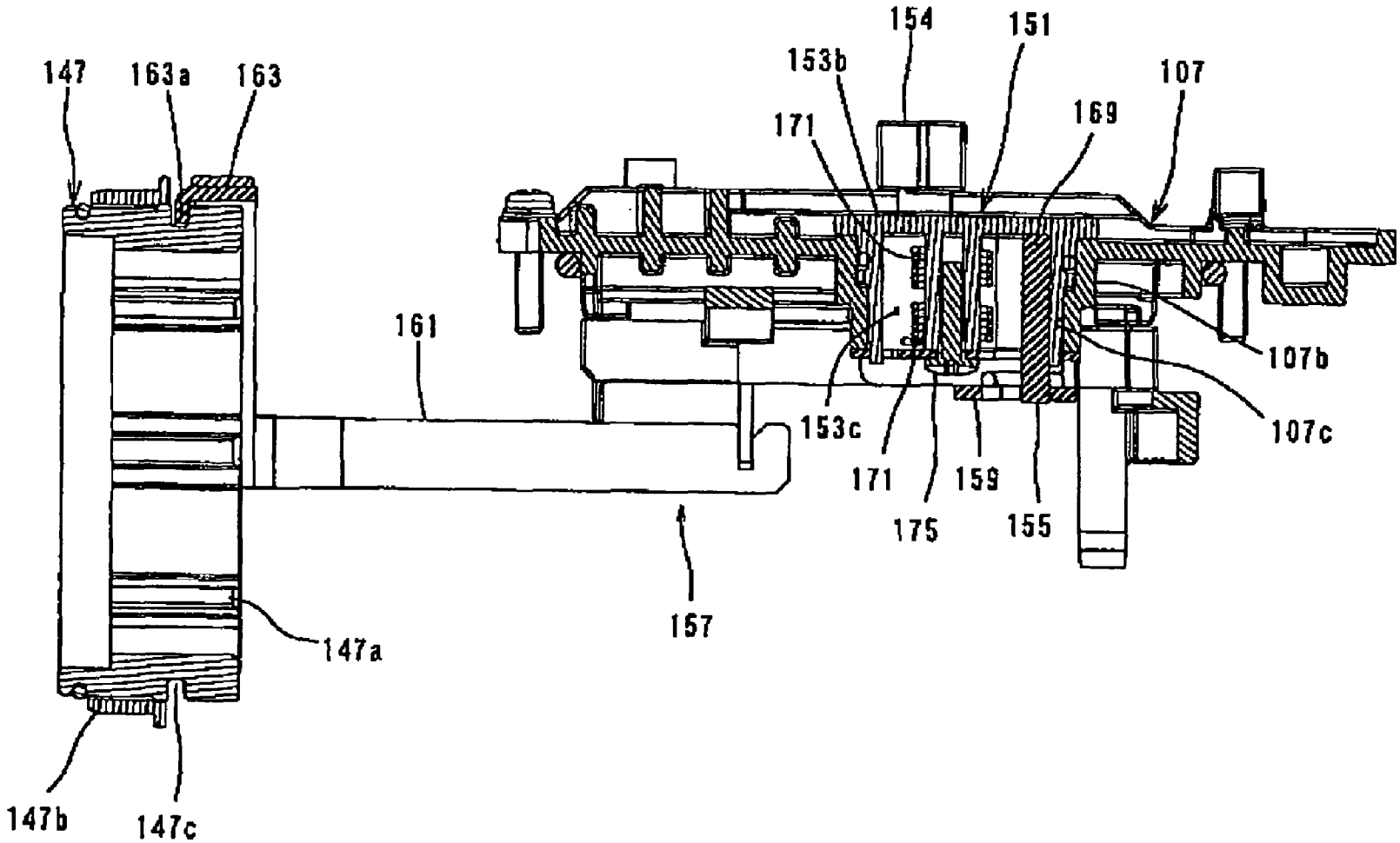
FIG. 6 is a view showing the state in which a cylindrical part of an operating member of the mode switching mechanism is mounted to a crank housing.

A mode switching mechanism 151 for switching the driving sleeve 147 between the power transmission state and the power transmission interrupted state will now be explained with reference to FIGS. 4 to 14. The mode switching mechanism 151 is a feature that corresponds to the "mode switching device" according to the invention. The mode switching mechanism 151 can be switched between hammer mode in which the hammer bit 119 is caused to perform only striking movement, and hammer drill mode in which the hammer bit 119 is caused to perform both the striking movement and rotation. As shown in FIGS. 4 to 6, the mode switching mechanism 151 mainly includes a mode-changing operating member 153, an eccentric pin 155 and a clutch operating mechanism 157. The operating member 153 can be turned in a horizontal plane by manual operation of the user. The eccentric pin 155 is caused to revolve (in a circular arc movement) on a rotation axis Q (see FIGS. 8 to 14) of the operating member 153. The clutch operating mechanism 157 is caused to move linearly via the eccentric pin 155 and switches the driving sleeve 147 of the power transmitting mechanism 117. The operating member 153 and the eccentric pin 155 are features that correspond to the "mode switching member" and the "acting member", respectively, according to the invention.

The operating member 153 includes an operating part 153*a* in the form of a disc with an operating grip, and a cylindrical part 153*b* disposed within the crank housing 107. The cylindrical part 153*b* is a feature that corresponds to the "circular portion" according to the invention. The operating part 153*a* is disposed externally on the crank housing 107 such that it can be manually operated by the user. The cylindrical part 153*b* is inserted into a mounting hole 107*c* of a cylindrical portion 107*b* of the crank housing 107 from the outside of the crank housing 107 (from above) (see FIG. 6). In this manner, the cylindrical part 153*b* is mounted to the crank housing 107 such that it can rotate in a horizontal plane. A crank pin 154 is disposed on the upper surface of the cylindrical part 153*b* in a position displaced a predetermined distance from the rotation axis Q of the operating member 153 or the rotation axis Q of the cylindrical part 153*b*. As shown in FIG. 4, the cylindrical part 153*b* is connected to the operating member 153 via the crank pin 154. Specifically, the cylindrical part 153*b* is rotated via the crank pin 154 by the operating part 153*a*.

The eccentric pin 155 is disposed on the lower side of the cylindrical part 153*b* in a position displaced a predetermined distance from the rotation axis Q of the operating member 153. When the operating member 153 is turned, the eccentric pin 155 revolves (in a circular arc movement) on the rotation axis Q of the operating member 153.

As shown in FIGS. 5 and 6, the clutch operating mechanism 157 includes a frame member 159 (see FIGS. 8 to 14), right and left rod-like members 161 connected to the frame member 159 and extending forward and a generally semicircular switching member 163 connected to the front end of the rod-like members 161. The frame member 159 is generally U-shaped in plan view and is caused to move linearly in the longitudinal direction of the cylinder 141 (in the axial direction of the hammer bit 119) by revolving movement of the eccentric pin 155 when the operating member 153 is turned in a horizontal plane. The frame member 159 is a feature that corresponds to the "driven-side member" according to the invention.

As shown in FIGS. 8 to 14, the frame member 159 has an oblong hole 159*a* extending in a direction crossing the longitudinal direction of the cylinder 141, and the eccentric pin 155 is engaged in the oblong hole 159*a*. When the operating member 153 is turned, the eccentric pin 155 revolves on the rotation axis Q of the operating member 153 and pushes the front or rear wall surface of the oblong hole 159*a*. At this time, the eccentric pin 155 moves the frame member 159 linearly in the longitudinal direction of the cylinder 141 by its longitudinal components (components in the longitudinal direction of the cylinder 141) of the revolving movement.

The rod-like members 161 are connected to the frame member 159 and extend horizontally in the longitudinal direction of the cylinder 141 through a space outside the rear end portion of the cylinder 141 and a space outside the large bevel gear 135. The generally semicircular switching member 163 is connected to the front end of the rod-like members 161 and disposed on the outer periphery of the driving sleeve 147. The switching member 163 has a protrusion 163*a* protruding radially inward, and the protrusion 163*a* engages with an annular groove 147*c* formed in the outer peripheral surface of the driving sleeve 147 such that it can move in the circumferential direction with respect to the driving sleeve 147. The frame member 159, the rod-like members 161 and the switching member 163 thus constructed linearly move together in one piece.

When the operating member 153 is turned, for example, from the hammer drill mode position to the hammer mode position, the eccentric pin 155 pushes the front wall surface of the oblong hole 159*a* of the frame member 159, so that the frame member 159 is moved forward. At this time, the driving sleeve 147 is caused to move forward away from the large bevel gear 135 via the rod-like members 161 and the switching member 163. Thus, the rear clutch teeth 147*a* of the driving sleeve 147 are disengaged from the clutch teeth 135*a* of the large bevel gear 135. In other words, the driving sleeve 147 is switched to the power transmission interrupted state. At the same time, the front clutch teeth 147*b* of the driving sleeve 147 engage with the fixed teeth 149 of the barrel part 107*a*. Thus, the driving sleeve 147 is locked against movement in the circumferential direction as the "variolock" works out.

When the operating member 153 is turned from the hammer mode position to the hammer drill mode position, the eccentric pin 155 pushes the rear wall surface of the oblong hole 159*a* of the frame member 159, so that the frame member 159 is moved rearward. At this time, the driving sleeve 147 is caused to move rearward toward the large bevel gear 135 via the rod-like members 161 and the switching member 163. Thus, the front clutch teeth 147*b* of the driving sleeve 147 are disengaged from the fixed teeth 149 of the barrel part 107*a*. At the same time, the rear clutch teeth 147*b* engage with the clutch teeth 135*a* of the large bevel gear 135. Thus, the driving sleeve 147 is switched to the power transmission state.

Figure 8:
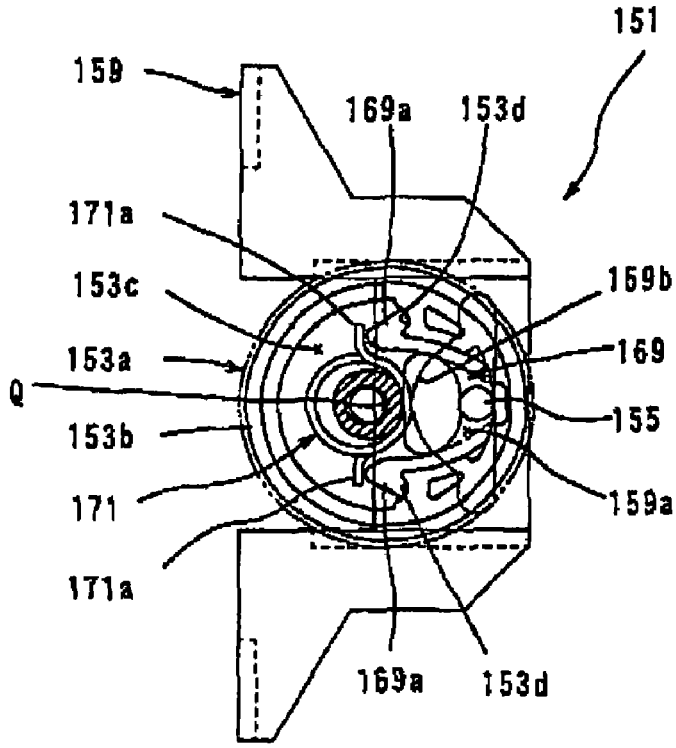
FIG. 8 is a plan view showing the mode switching mechanism in the state in which the operating member is turned to a hammer drill mode position and the clutch mechanism is engaged.
Figure 11:
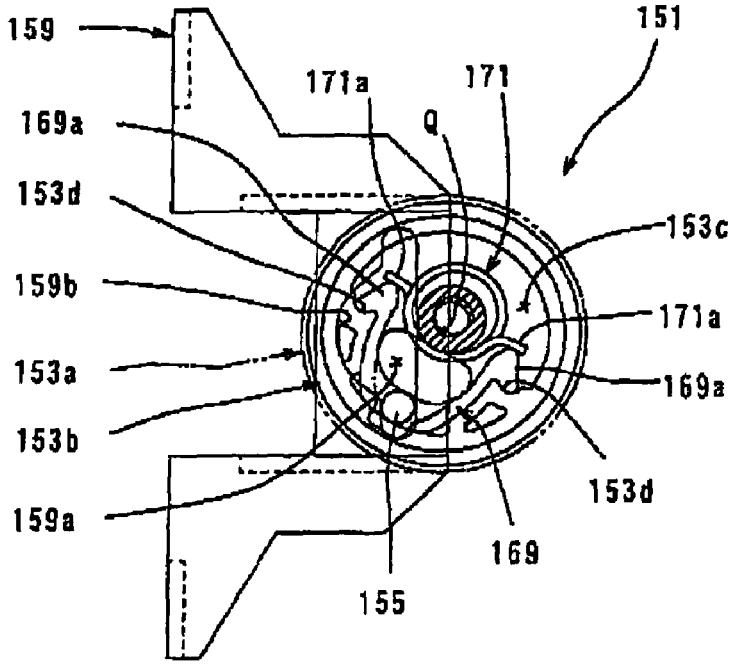
FIG. 11 is a plan view showing the mode switching mechanism in the state in which the operating member is turned to one hammer mode position and the clutch mechanism is engaged.
Figure 14:
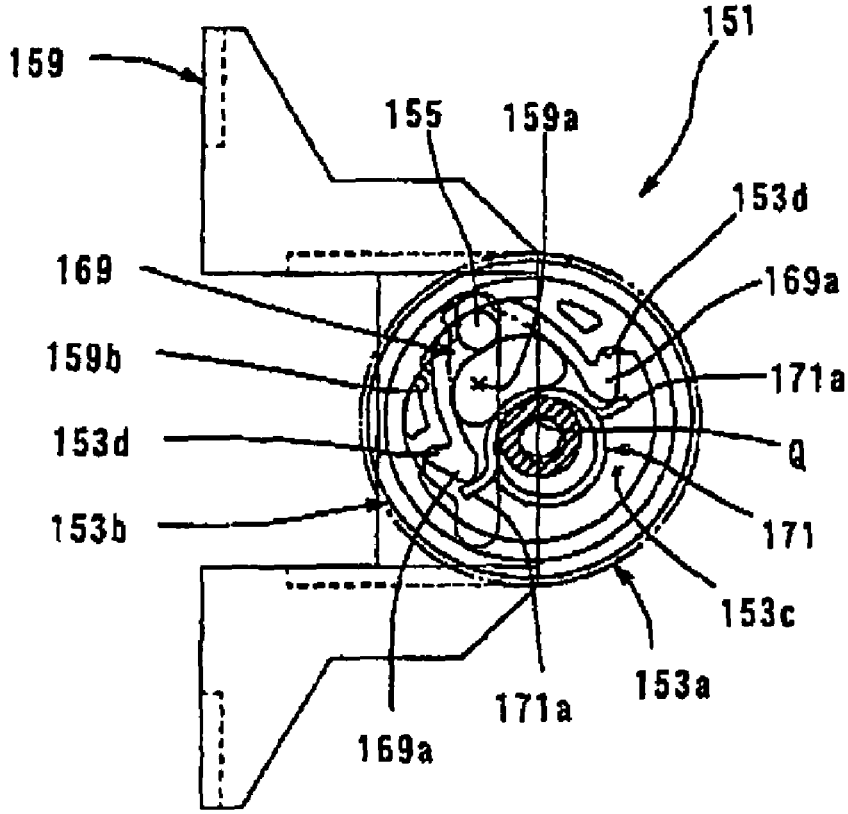
FIG. 14 is a plan view showing the mode switching mechanism in the state in which the operating member is turned to the other hammer mode position and the clutch mechanism is engaged.

In this embodiment, a retracting end position in which the eccentric pin 155 is in the rearmost position is defined as the hammer drill mode position. This state is shown in FIG. 8. When the eccentric pin 155 is placed in the hammer drill mode position, the rear clutch teeth 147*a* of the driving sleeve 147 engage with the clutch teeth 135*a* of the large bevel gear 135, so that the driving sleeve 147 is switched to the power transmission state. On the other hand, a position displaced with a phase difference of 120° from the hammer drill mode position in the circumferential direction is defined as the hammer mode position. Therefore, two hammer mode positions are provided in the symmetrical position with respect to the travel line of the frame member 159 which passes through the rotation axis Q of the operating member 153. Specifically, as shown in FIGS. 11 and 14, one hammer mode position is set in a position rotated 120° clockwise from the hammer drill mode position, and the other hammer mode position is in a position rotated 120° counterclockwise from the harder drill mode position. When the eccentric pin 155 is placed in the hammer mode position, the front clutch teeth 147*b* of the driving sleeve 147 engage with the fixed teeth 149 of the barrel part 107*a*, so that the driving sleeve 147 is held in the "variolock" state.

Due to provision of the two hammer mode positions as described above, when the eccentric pin 155 revolves between the two hammer mode positions, the eccentric pin 155 interferes with the front wall surface of the oblong hole 159*a*, so that it may be locked against revolving movement. In this embodiment, in order to overcome such problem, a circular arc surface 159*b* is partially formed on the front side (the hammer bit side) of the wall surface of the oblong hole 159*a*, while the wall surface of the oblong hole 159*a* on the rear side (the handgrip 109 side) is formed straight. The circular arc surface 159*b* is shaped to correspond to apart of the travel path (of the circular arc movement) of the eccentric pin 155 that revolves on the rotation axis Q of the operating member 153.

Although not particularly shown in drawings, the two hammer mode positions and the hammer drill mode position are marked on the crank housing 107 at 120° intervals in the circumferential direction. The operating member 153 can be switched to a desired mode position by placing a pointer of the operating part 153*a* on the appropriate mark.

In the state in which the driving motor 111 is not driven, when the user turns the operating member 153 such that the driving sleeve 147 is caused to move forward or rearward to switch the clutch mechanism, the clutch teeth 147*a* or 147*b* of the driving sleeve 147 may possibly climb on the clutch teeth 135*a* of the large bevel gear 135 or the fixed teeth 149 of the barrel part 107*a* (the side surfaces of the tooth tops contact each other), so that the movement of the driving sleeve 147 may be interrupted. Therefore, in order to allow the operating member 153 to be turned to a desired mode position even if such climbing occurs, in the mode switching mechanism 151 according to the embodiment, the eccentric pin 155 is mounted to the cylindrical part 153*b* of the operating member 153 such that it can be displaced with respect to the cylindrical part 153*b*. The structure for mounting the eccentric pin 155 to the operating member 153 will now be explained with reference mainly to FIG. 8.

As shown in FIG. 8, a pin bolder 169 is generally U-shaped in plan view and disposed within a bore 153*c* of the cylindrical part 153*b* and adjacent to its inner wall surface. The bore 153*c* is a feature that corresponds to the "recess" according to the invention The eccentric pin 155 is integrally connected to the pin holder 169 disposed within the bore 153*c* and linearly extends from the bottom of the U-shape of the pin holder 169 to the outside of the cylindrical part 153*b* along the rotation axis of the operating member 153. A hook-like engagement portion 169*a* is formed in each end of the pin holder 169 on the open side of the U-shape. A pair of engagement recesses 153*d* are formed in the inner wall surface of the cylindrical part 153*b* and arranged in a symmetrical position with respect to a line connecting the rotation axis Q of the operating member 153 and the center of the eccentric pin 155. The engagement portions 169*a* of the pin holder 169 engage with the engagement recesses 153*d*.

The pin bolder 169 can swing radially inward of the cylindrical part 153*b* on either one of the engagement recesses 153*d*. To this end, the engagement surfaces of the engagement portions 169*a* and the engagement recesses 153*d* comprise mutually complementary curved surfaces. Thus, the eccentric pin 155 is caused to move radially inward toward the rotation axis Q of the cylindrical part 153*b* by swinging clockwise or counterclockwise on either one of the engagement recesses 153*d* together with the pin holder 169.

A torsion spring 171 is disposed in the bore 153*c* of the cylindrical part 153*b*. In this embodiment, two torsion springs 171 are provided, but only one torsion spring may be provided. The torsion spring 171 has arms 171*a* formed on the both ends and extending radially outward. The torsion spring 171 is disposed such at one of the arms 171*a* contacts one of the engagement portions 169*a* and the other arm 171*a* contacts the other engagement portion 169*a*. In this manner, the eccentric pin 155 is held in the position in which the two engagement portions 169*a* are engaged with the associated engagement recesses 153*d*. This position of the eccentric pin 155 corresponds to the "initial position" according to the invention.

When the eccentric pin 155 swings on either one of the engagement recesses 153*d* together with the pin holder 169, the other engagement portion 169*a* moves away from the other associated engagement recess 153*d* and pushes the associated arm 171*a* of the torsion spring 171. Thus, the torsion spring 171 builds up the spring force. The torsion spring 171 is a feature that corresponds to the "elastic element" according to the invention. Further, the torsion spring 171 is loosely fitted onto a cylindrical spring guide 173 formed near the rotation axis Q within the bore 153*c*, so that the torsion spring 171 is prevented from moving freely in the radial direction.

Figure 7A:
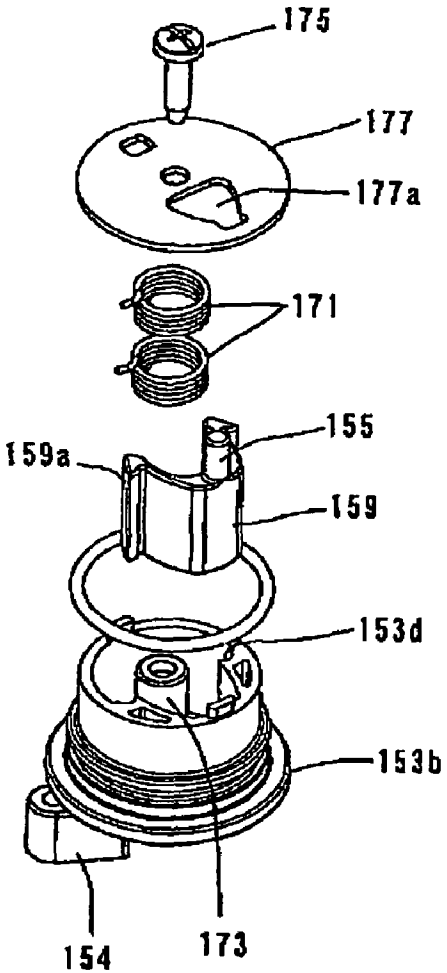
FIG. 7(A) shows the state before assembling.
Figure 7:
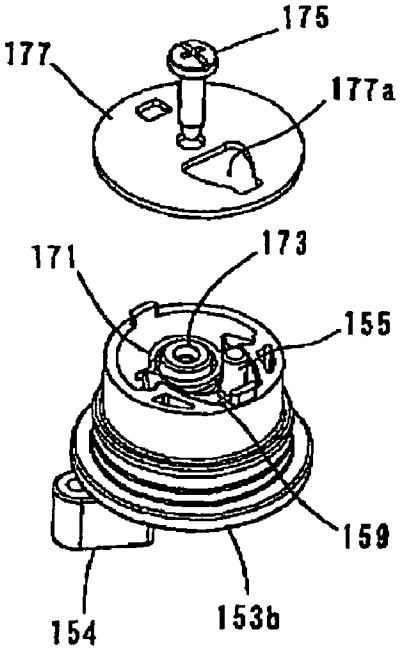
Figure 7C:
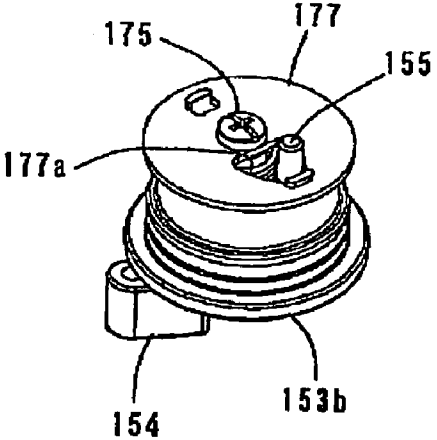
FIG. 7(C) shows the state after assembling.

FIG. 7 shows the structure for assembling the eccentric pin 155 and the torsion spring 171 to the cylindrical part 153*b*. As shown, the pin holder 169 with the eccentric pin 155 and the torsion spring 171 are inserted into the bore 153*c* of the cylindrical part 153*b* and placed in a predetermined position. Thereafter, a disc-like cover plate 177 is fastened to the spring guide 173 by a screw 175 and covers the bore 153*c* of the cylindrical part 153*b*. Thus, the pin holder 169 and the torsion spring 171 are held within the bore 153*c*. At this time, the eccentric pin 155 protrudes outward through an opening 177*a* formed in the cover plate 177. The opening 177*a* has an opening area wide enough to allow the eccentric pin 155 to swing.

Figure 9:
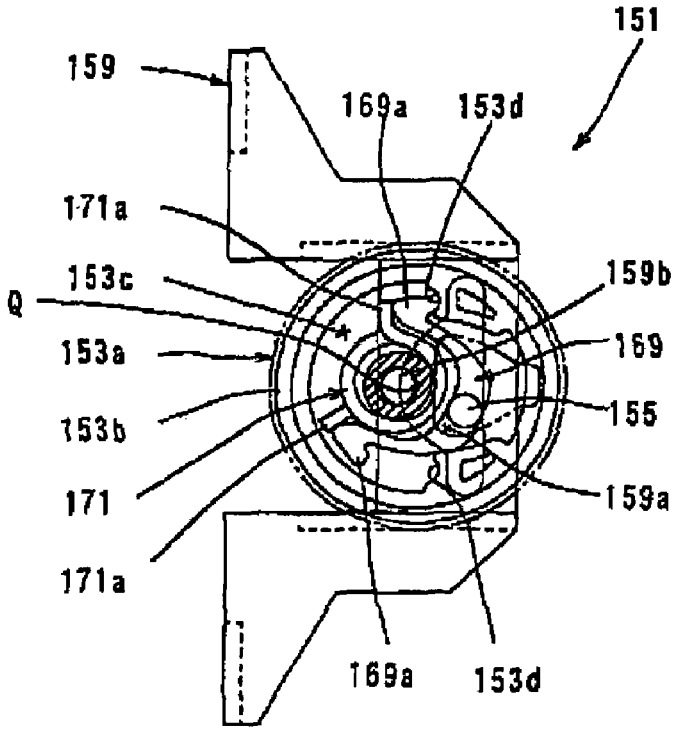
FIG. 9 is a plan view showing the mode switching mechanism in the state in which the operating member is turned to a hammer drill mode position and the switching movement of the clutch mechanism is interrupted.

The mode switching mechanism 151 of this embodiment is thus constructed. FIGS. 8 and 9 show the state in which the operating member 153 is in the hammer drill mode position. FIG. 8 shows the relative position of the eccentric pin 155 with respect to the operating member 153 in the state in which the rear clutch teeth 147*a* of the driving sleeve 147 are in engagement with the clutch teeth 135*a* of the large bevel gear 135. FIG. 9 shows the relative position of the eccentric pin 155 with respect to the operating member 153 in the state in which the rear clutch teeth 147*a* of the driving sleeve 147 climb on the clutch teeth 135*a* of the large bevel gear 135 and the movement of the driving sleeve 147 is interrupted.

When the user turns the operating member 153 from the hammer mode position toward the hammer drill mode position, the driving sleeve 147 moves rearward. At this time, when the rear clutch teeth 147*a* of the moving driving sleeve 147 climb on the clutch teeth 135*a* of the large bevel gear 135, the rearward movement of the driving sleeve 147 is interrupted. In this state, when the operating member 153 is further turned to the hammer drill mode position, as shown in FIG. 9, the eccentric pin 155 is pushed back forward by the rear wall surface of the oblong hole 159*a* of the frame member 159 and swings radially inward toward the rotation axis Q of the cylindrical part 153*b* on the engagement recess 153*d* together with the pin holder 169. At this time, the other engagement portion 169*a* swings away from the other associated engagement recesses 153*d* and pushes the associated arm 171*a* of the torsion spring 171. Thus, the torsion spring 171 is elastically deformed and builds up the spring force.

Thereafter, when the driving motor 111 is driven, the large bevel gear 135 is rotationally driven. At this time, when the tops of the clutch teeth 135*a* of the large bevel gear 135 mesh with the bottoms of the rear clutch teeth 147*a* of the driving sleeve 147, the eccentric pin 155 is caused to swing radially outward on the one engagement recess 153*d* together with the pin holder 169 by the spring force of the torsion spring 171. Thus, the eccentric pin 155 is moved to its original or initial position in which the other engagement portion 169*a* engages with the other associated engagement recess 153*d*. As a result, the frame member 159 is moved rearward, and thus the driving sleeve 147 is moved toward the large bevel gear 135 via the rod-like members 161 and the switching member 163. Thus, the clutch teeth 147*a* engage with the clutch teeth 135*a*.

Figure 10:
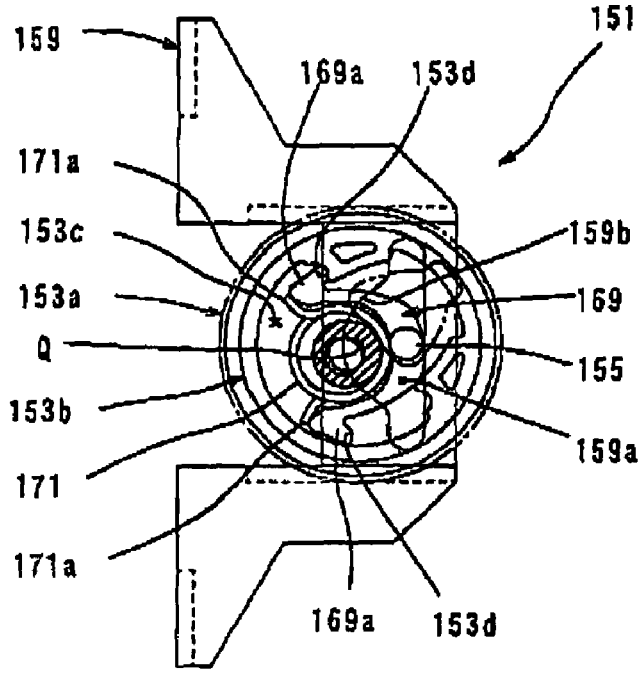
FIG. 10 is a plan view showing the state in which the operating member is further turned from the state shown in FIG. 9.

FIG. 10 shows the state in which the operating member 153 is further turned beyond the hammer drill mode position from the state shown in FIG. 9 in which the clutch teeth 147*a* of the driving sleeve 147 climb on the clutch teeth 135*a* of the large bevel gear 135. The eccentric pin 155 is further moved radially inward from the position shown in FIG. 9 to a position nearer to the rotation axis Q of the operating member 153, which allows the operating member 153 to further rotate in the some direction. Specifically, according to the embodiment, even if the clutch teeth 147*a* of the driving sleeve 147 climb on the clutch teeth 135*a* of the large bevel gear 135, the operating member 153 can be continuously turned in the same direction and switched to the next mode.

Figure 12:
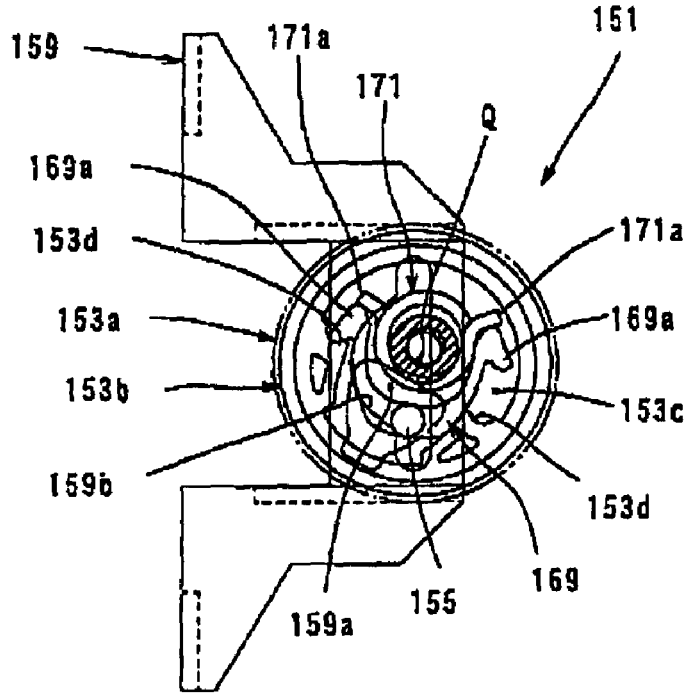
FIG. 12 is a plan view showing the mode switching mechanism in the state in which the operating member is turned to one hammer mode position and the switching movement of the clutch mechanism is interrupted.

FIGS. 11 and 12 show the state in which the operating member 153 is turned clockwise from the hammer drill mode position to the hammer mode position. FIG. 11 shows the relative position of the eccentric pin 155 with respect to the operating member 153 in the state in which the front clutch teeth 147*b* of the driving sleeve 147 are in engagement with the fixed teeth 149 of the barrel portion 107*a*. FIG. 12 shows the relative position of the eccentric pin 155 with respect to the operating member 153 in the state in which the front clutch teeth 147*b* of the driving sleeve 147 climb on the fixed teeth 149 of the barrel portion 107*a* and the movement of the driving sleeve 147 is interrupted.

When the user turns the operating member 153 toward the hammer mode position, the driving sleeve 147 moves forward. At this time, when the front clutch teeth 147*b* of the moving driving sleeve 147 climb on the fixed teeth 149 of the barrel portion 107*a*, the forward movement of the driving sleeve 147 is interrupted. In this state, when the operating member 153 is further turned to the hammer mode position, as shown in FIG. 12, the eccentric pin 155 is pushed back forward by the front wall surface of the oblong bole 159*a* of the frame member 159 and swings radially inward toward the rotation axis Q of the cylindrical part 153*b* on the engagement recess 153*d* together with the pin holder 169. At this time, the other engagement portion 169*a* swings away from the other associated engagement recess 153*d* and pushes the associated arm 171*a* of the torsion spring 171. Thus, the torsion spring 171 is elastically deformed and builds up the spring force.

Thereafter, the user holds the hammer bit 119 by hand and turns the tool holder 137 clockwise or counterclockwise. At this time, when the tops of the clutch teeth 147*a* of the driving sleeve 147 which rotates together with the tool holder 137 mesh with the bottoms of the fixed teeth 149 of the barrel portion 107*a*, the eccentric pin 155 is caused to swing radially outward on the one engagement recess 153*d* together with the pin holder 169 by the spring force of the torsion spring 171. Thus, the eccentric pin 155 is moved to its initial position. As a result, the frame member 159 is moved forward, and thus the driving sleeve 147 is moved forward via the rod-like members 161 and the switching member 163. Thus, the front clutch teeth 147*b* engage with the fixed teeth 149 of the barrel portion 107*a*.

Figure 13:
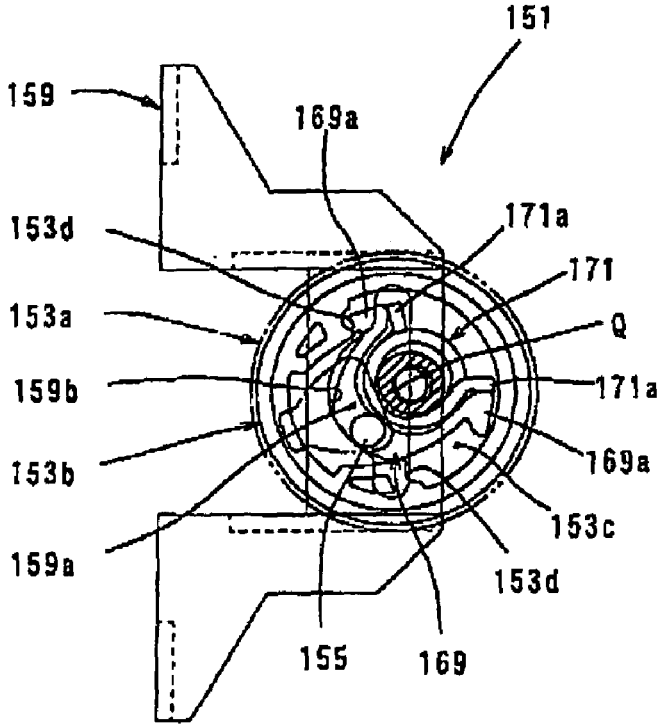
FIG. 13 is a plan view showing the state in which the operating member is further turned from the state shown in FIG. 12.

FIG. 13 shows the state in which the operating member 153 is further turned beyond the one hammer mode position from the state shown in FIG. 12 in which the front clutch teeth 147*b* of the driving sleeve 147 climb on the fixed teeth 149 of the barrel portion 107*a*, and to the other hammer mode position. In this embodiment, the circular arc surface 159*b* is formed on the front wall of the oblong hole 159*a* of the frame member 159 and shaped to correspond to a part of the travel path (of the circular arc movement) of the eccentric pin 155 that revolves on the rotation axis Q of the operating member 153. Therefore, the eccentric pin 155 moves on the circular arc surface 159*b* without changing the relative position with respect to the operating member 153, which allows the operating member 153 to further rotate in the same direction.

FIG. 14 shows the state in which the operating member 153 is turned counterclockwise from the hammer drill mode position to the hammer mode position (or the operating member 153 is further turned clockwise from the state shown in FIG. 13 to the other hammer mode position). When the operating member 153 is turned counterclockwise to the hammer mode position, even if the front clutch teeth 147*b* of the driving sleeve 147 climb on the fixed teeth 149 of the barrel portion 107*a* and the forward movement of the driving sleeve 147 is interrupted, the eccentric pin 155 or other associated elements act in the same manner as in the above-described clockwise turn of the operating member 153.

As described above, when the movement of the driving sleeve 147 is interrupted during mode switching of the operating member 153, which causes the frame member 159 to be prevented from moving linearly, the eccentric pin 155 moves radially inward of the cylindrical part 153*b* while elastically deforming the torsion spring 171. In this manner, the operating member 153 can be turned to a desired mode position without interruption. Further, when the interruption of the movement of the driving sleeve 147 is resolved, the driving sleeve 147 can be moved to its normal position via the eccentric pin 155 and the clutch operating mechanism 157 by the accumulated spring force of the torsion spring 171.

Particularly, because the eccentric pin 155 moves radially inward of the operating member 153 with respect to the operating member 153, the torsion spring 171 that applies a spring force to the eccentric pin 155 can be disposed on the cylindrical part 153*b* (the operating member 153) side. Therefore, the arms 171*a* of the torsion spring 171 can be reduced in length so that the size of the torsion spring can be reduced. Further, with the construction in which the eccentric pin 155 directly engages (contacts) with the frame member 159, the operating member 153 and the frame member 159 can be disposed adjacent to each other, so that the installation space can be reduced.

Further, because the eccentric pin 155 moves radially inward by swinging on the engagement recess 153*d* of the cylindrical part 153*b* together with the pin holder 169, the inward movement of the eccentric pin 155 can be realized in the limited space. Further, because the eccentric pin 155 can swing on the two points which are symmetrically positioned with respect to a line connecting the rotation axis Q of the operating member 153 and the center of the eccentric pin 155 placed in the initial position, mode switching can be effected whichever direction the operating member 153 is turned on the rotation axis Q. Thus, the ease of use in switching operation can be increased.

Further, because the pin holder 169 and the torsion sprig 171 are disposed within the cylindrical part 153*b* of the operating member 153, economical and simple placement can be realized. Further, with the construction that the pin holder 169 and the torsion spring 171 do not protrude radially outward of the cylindrical part 153*b*, the cylindrical part 153*b* can be more easily inserted into the mounting hole 107*c* of the cylindrical portion 107*b* of the crank housing 107 during the assembling process of the tool.

While mode switching is described as being made between hammer mode and hammer drill mode in the representative embodiment, a clutch mechanism may be provided on the motion converting mechanism 113 side. The clutch mechanism can be switched to the power transmission interrupted state while the above-mentioned power transmitting mechanism 117 side is placed in the power transmission state, so that the hammer bit 119 can be driven in drill mode in which it is caused to perform only rotation on its axis.

While the hammer drill is described as an example of the power tool according to the representative embodiment, the invention can also be applied to an electric drill in which the rotational speed of the tool bit can be selected between high speed and low speed. Further, the invention can be applied to any power tool which has a mode switching device for switching the driving mode of the tool bit.

DESCRIPTION OF NUMERALS

101 hammer drill (power tool)
103 body (tool body)
105 motor housing
107 crank housing
107*a* barrel part
107*b* cylindrical portion
107*c* mounting hole
109 handgrip
111 driving motor

113 motion converting mechanism
115 striking mechanism
117 power transmitting mechanism
119 hammer bit (tool bit)
121 driving gear
123 driven gear
125 crank shaft
127 crank arm
129 piston
132 intermediate gear
133 intermediate shaft
134 small bevel gear
135 large bevel gear
135*a* clutch teeth
137 tool holder
141 cylinder
141*a* air chamber
143 striker
145 impact bolt
147 driving sleeve (mode switching mechanism)
147*a* clutch teeth
147*b* clutch teeth
147*c* annular groove
149 fixed teeth
151 mode switching mechanism (mode switching device)
153 operating member (mode switching member)
153*a* operating part
153*b* cylindrical part
153*c* bore (recess)
153*d* engagement recess
154 crank pin
155 eccentric pin (actuating member)
157 clutch operating mechanism
159 frame member (driven-side member)
159*a* oblong hole
159*b* circular arc surface
161 rod-like member
163 switching member
163*a* protrusion
169 pin holder
169*a* engagement portion
171 torsion spring (elastic element)
171*a* arm
173 spring guide
175 screw
177 cover plate
177*a* opening

We claim:

1. A power tool comprising a mode switching device that switches a driving mode of a tool bit among a plurality of different driving modes, wherein the mode switching device includes:

a mode switching member that is structured to be turned by manual operation, a driven-side member that is structured to linearly move in a direction crossing a rotation axis of the mode switching member, a mode switching mechanism that is actuated by linear motion of the driven-side member, an actuating member that is disposed on the mode switching member such that an initial position of the actuating member is located in a position displaced in a radial direction from the rotation axis of the mode switching member, wherein, when the mode switching member is turned, the actuating member is caused to revolve in a circular arc movement in contact with the driven-side member, thereby causing the driven-side member to linearly move via components of the circular arc movement in the direction of the linear movement of the driven-side member, wherein the actuating member is structured to move radially inward of the mode switching member from the initial position toward the rotation axis of the mode switching member with respect to the mode switching member; and an elastic element that is elastically deformed by the actuating member when the actuating member moves radially inward from the initial position, whereby the elastic element builds up a spring force to return the actuating member to the initial position, wherein, when the driven-side member is prevented from moving linearly by interruption of the movement of the mode switching mechanism during turning operation of the mode switching member for mode change, the actuating member moves radially inward of the mode switching member while elastically deforming the elastic element, thereby allowing the mode switching member to be turned, and when the interruption of the movement of the mode switching mechanism is resolved and the linear movement of the driven-side member is allowed in the state in which the mode switching member is turned, the actuating member moves back to the initial position by the accumulated spring force of the elastic element, which causes the driven-side member to linearly move, and wherein the radially inward movement of the actuating member with respect to the mode switching member is a swinging movement on a fixed point other than the rotation axis of the mode switching member.

2. The power tool as defined in claim 1, wherein the actuating member is structured to swing on either of two points which are substantially symmetrically positioned with respect to a line connecting the rotation axis of the mode switching member and the center of the actuating member placed in the initial position.

3. The power tool as defined in claim 1 further comprising:

a tool body having a mounting hole in which the mode switching member is mounted, wherein the mode switching member includes a circular portion which is rotatably fitted in the mounting hole, the circular portion having a recess formed along the direction of the rotation axis, the elastic element and the entire actuating member except for a portion which contacts the driven-side member being disposed within the recess.

4. The power tool as defined in claim 1, wherein the actuating member is structured to swing on either of two points which are substantially symmetrically positioned with respect to a line connecting the rotation axis of the mode switching member and the center of the actuating member placed in the initial position, wherein the mode switching member has two engagement recesses that are substantially symmetrically positioned with respect to a line connecting the rotation axis of the mode switching member and the center of the actuating member placed in the initial position, wherein the actuating member has two engagement portions that are structured to disengageably and rotatably engage with the associated engagement recesses, and wherein the elastic element comprises a torsion spring and includes two arms extending radially outward, and one of the arms of the torsion spring is held in contact with one of the engagement portions such that the one engagement portion engages with one of the engagement recesses, while the other arm of the torsion spring is held in contact with the other engagement portion such that the other engagement portion engages with the other engagement recess.

5. The power tool as defined in claim 1, wherein the tool bit of the power tool is driven in at least one hammer mode and a hammer drill mode.

* * * * *